US007207842B1

(12) United States Patent
Kenjo

(10) Patent No.: US 7,207,842 B1
(45) Date of Patent: Apr. 24, 2007

(54) ELECTRICAL CONNECTOR

(75) Inventor: Mitsunori Kenjo, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/582,998

(22) Filed: Oct. 19, 2006

(30) Foreign Application Priority Data

Oct. 21, 2005 (JP) ..... 2005-307086

(51) Int. Cl.
*H01R 13/648* (2006.01)

(52) U.S. Cl. ..... 439/607; 439/74; 439/660

(58) Field of Classification Search ..... 439/74, 439/108, 660, 607–610
See application file for complete search history.

(56) References Cited

U.S. PATENT DOCUMENTS 6,056,560 A * 5/2000 Wu et al. ..... 439/108
6,361,358 B1 * 3/2002 Kajinuma ..... 439/497
6,623,308 B2 * 9/2003 Ono ..... 439/680
6,645,005 B2 * 11/2003 Wu ..... 439/563

FOREIGN PATENT DOCUMENTS

JP 2000-331731 11/2000

* cited by examiner

*Primary Examiner*—James R. Harvey
(74) *Attorney, Agent, or Firm*—Takeuchi & Kubotera, LLP

(57) ABSTRACT

An electric connector to be attached to a circuit board, includes: a housing having a sidewall portion, a first outer side surface, and a second outer side surface; a fitting protruding portion formed in the housing for receiving a mating connector, and including an opening portion and extending in a longitudinal direction of the housing; a terminal including a first contact portion for connecting with a mating terminal of the mating connector and a connecting portion arranged on the sidewall portion for connecting to the circuit board; and a ground plate attached to the housing and extending in the longitudinal direction. The ground plate includes a first ground main portion facing the first outer side surface and a second ground main portion facing the second outer side surface. The first ground main portion is arranged to form a space between the first ground main portion and the first outer side surface so that the connecting portion can be connected to the circuit board.

6 Claims, 7 Drawing Sheets

ELECTRICAL CONNECTOR

BACKGROUND OF THE INVENTION AND RELATED ART STATEMENT

The present invention relates to an electrical connector to be attached to a circuit board in use.

A connector disclosed in Patent Reference 1 has been known as a connector of this type. As shown in FIG. 7, in the connector disclosed in Patent Reference 1, a held portion 52A of a terminal 52 is inserted into a groove of a housing 51 of a connector 50 to be held by a housing 51. One end side (left side in the drawing) is bent in a U character shape, and has a contact portion 52B at a free end portion thereof. The other end side is formed in an L character shape to protrude outside the housing, and a lower end portion thereof is formed in a contact portion 52C. The connector 50 is disposed on a circuit board P, and the connect portion 52C is connected to a corresponding circuit portion P1 of the circuit board P with solder.

In a mating connector 60 to be fitted and connected to the connector 50, a coaxial cable C is held between a portion 61A of an insulation member 61 and a ground plate 62 with a cover shape. A bent center conductor C1 of the coaxial cable C and a terminal 63 with a U character shape are held with the other portion 61B of the insulation member 61.

One end 63A of the terminal 63 is situated between the center conductor C1 and the other portion 61B of the insulation member 61 and contacts with the center conductor C1. The other end is branched into two tongue pieces 63B and 63C. The tongue piece 63B contacts with the center conductor C1, and the tongue piece 63C contacts with the contact portion 52B of the terminal 52 of the connector 50.

The ground plate 62 of the connector 60 has an upper plate portion 62A and a side plate portion 62B extending along a left side surface of the housing. The side plate portion 62B extends up to a position of a surface of the circuit board P.

[Patent Reference 1] Japanese Patent Publication No. 2000-331731

In the connector of Patent Reference 1 shown in FIG. 7, when the connector 60 is fitted into the connector 50, the ground plate 62 of the connector 60 shields many of surrounding areas.

However, there is no ground plate in the connector 50 or the connector 60 at a position of the connecting portion 52C of the connector 50, thereby leaking noise from the position.

In view of the problems described above, an object of the present invention is to provide an electrical connector for a circuit board, in which it is possible to shield at a connecting portion of a connector.

According to the present invention, the electrical connector is attached to the circuit board. A fitting protruding portion extends in a longitudinal direction of a housing, and opens upward for receiving a mating connector. A contact portion of a terminal is arranged on an inner side surface of one sidewall portion forming the fitting protruding portion. A contact portion of the terminal is arranged on an outer side surface of the sidewall portion. A ground plate is attached to the housing along an outer side surface of the housing in the longitudinal direction.

SUMMARY OF THE INVENTION

In the electric connector of the present invention, the ground plate is attached to at least the housing along the outer side surface in the longitudinal direction. One ground plate is situated on a side of the connecting portion of the terminal, and is arranged to have a distance from the outer side surface of the housing. Accordingly, a space is formed within the distance for allowing the connecting portion to connect to the circuit board.

According to the present invention, the both outer side surfaces in the longitudinal direction consisting at least almost whole area of an outer surface of the housing are covered, so that substantially complete shielding is achieved. At this time, the connecting portion of the terminal is situated between the ground plate and the outer side surface of the housing, thereby not interfering with the shielding.

According to the present invention, it is preferred that the one ground plate has a contact section for contacting with a mating ground plate.

Accordingly, the ground plate improves shielding effect together with the mating ground plate, and it is easy to ground through the contact section.

According to the present invention, the ground plate may have two attaching portions to be attached to the housing from above at both end portions in the longitudinal direction of the housing; one and the other ground main portions respectively facing the both side surfaces of the housing over between the both end portions; and a connecting member connecting the one and the other ground main portions at the attaching portions at the both end portions. The attaching portions, the ground main portions, and the connecting member are formed of one metal plate.

Accordingly, it is possible to produce the ground plate as one single part, thereby making structure simple, reducing a number of parts, and making maintenance of parts easy.

It is preferred that the attaching portions are formed to fit into the housing, and the connecting member is arranged to contact with the circuit board. Accordingly, attachment at the attaching portions is made easy. The connecting member can be attached to the circuit board with solder, so that the connector is strongly held on the circuit board and securely grounded.

According to the present invention, the ground plates are situated at the both outer side surfaces of the housing. At least one of the ground plates on a side in an extension direction of a cable extending from the mating connector in a direction perpendicular to the longitudinal direction and in parallel to the circuit board may have a cut portion for avoiding interference with the cable in a state fitted to the mating connector.

Accordingly, when the mating connector is so-called an L type connector having the cable extending in parallel to the surface of the circuit board, the shield effect is significantly improved as opposed to a conventional connector in which a shield is not provided due to the cable.

According to the present invention, the contact section of the one ground plate is formed of an elastic tongue piece bent toward the corresponding outer side surface of the housing, so that the elastic tongue piece elastically contacts with the mating ground plate. The elastic tongue piece is provided using a space between the ground plate and the outer side surface of the housing, so that the distance is not increased due to the elastic tongue piece.

As described above, in the present invention, the respective ground plates are arranged along the outer side surfaces of the housing extending along the longitudinal direction. Accordingly, together with the ground plate of the mating connector, the ground plates surround the both connectors substantially completely, thereby improving shielding effect.

At this time, the one ground plate is situated outside relative to the connecting portion of the terminal. The distance between the ground plate and the outer side surface of the housing allows the connecting portion to connect to the circuit board. Accordingly, it is possible to maintain shielding effect at the connecting portion substantially completely.

BRIEF DESCRIPTION OF THE DRAWINGS

FIGS. 6(A) and 6(B) are sectional views of the electrical connector shown in FIG. 1 at a position of a terminal when the connector is fitted into the mating connector, wherein FIG. 6(A) shows a state without the ground plate, and FIG. 6(B) shows a state with the ground plate.

DETAILED DESCRIPTION OF PREFERRED EMBODIMENTS

Hereunder, an electrical connector for a circuit board according to an embodiment of the present invention will be explained with reference to the accompanying drawings, i.e., FIG. 1 to FIGS. 6(A) and 6(B).

Figure 1:
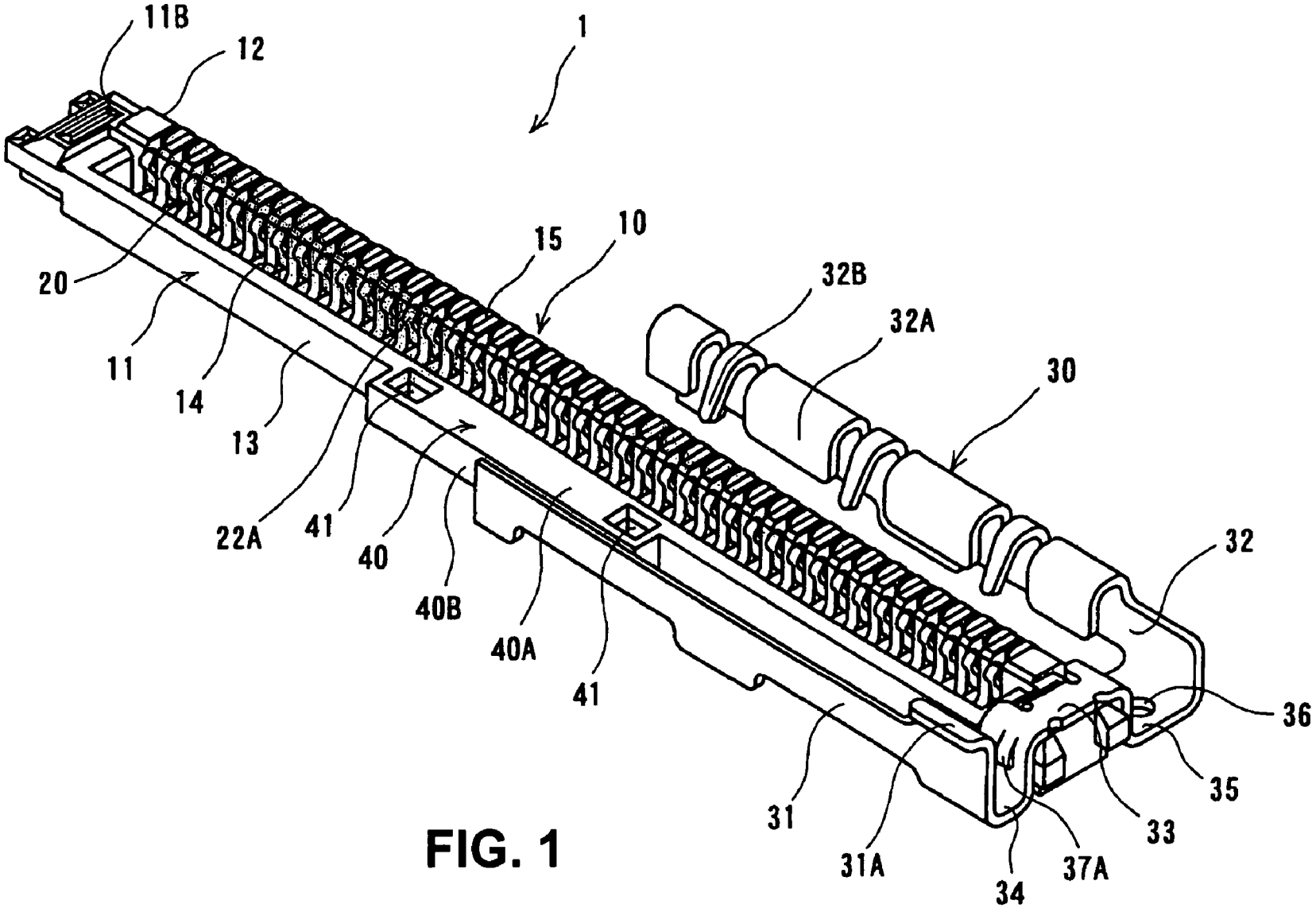
FIG. 1 is a perspective view showing an electrical connector with a ground plate according to an embodiment of the present invention, in which a half of the ground plate in a longitudinal direction of the connector is omitted.
Figure 2:
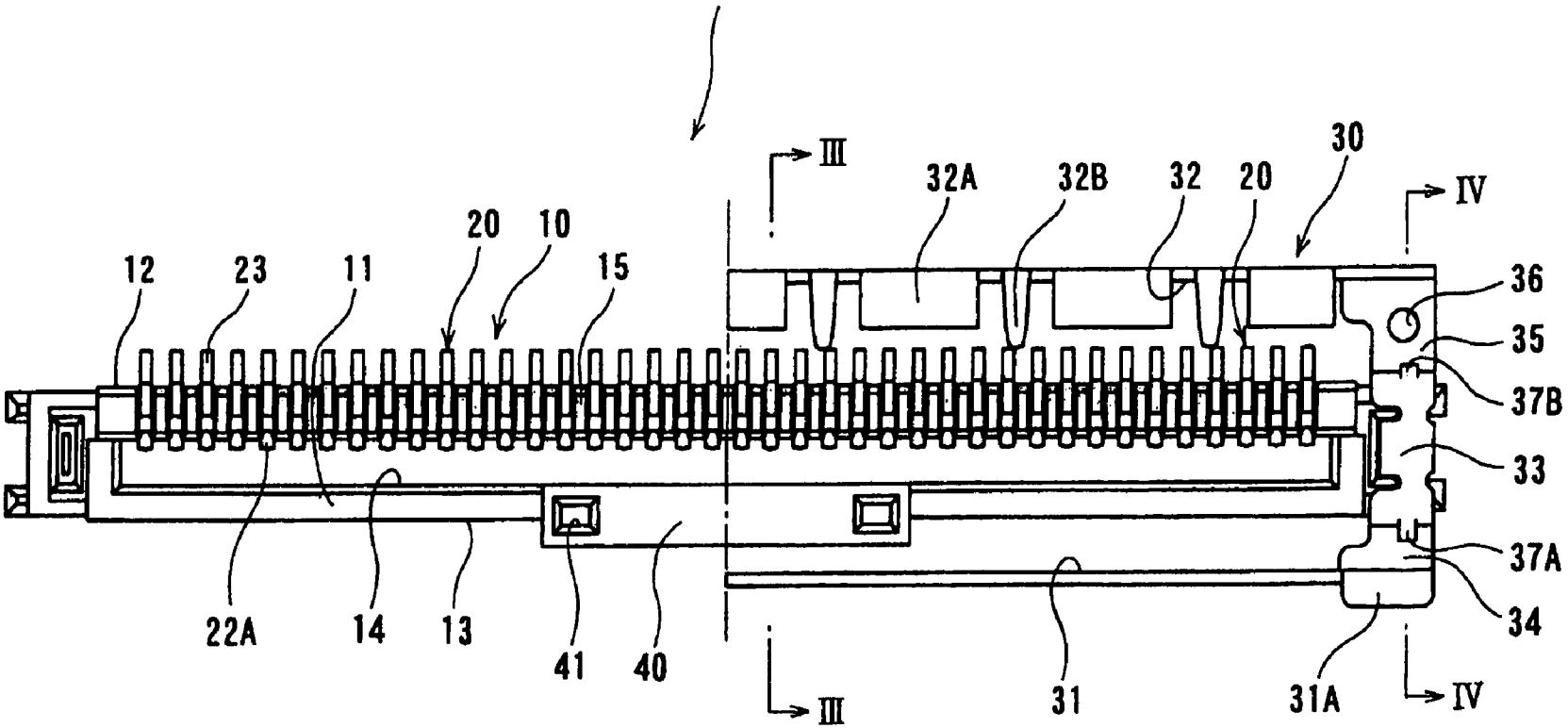
FIG. 2 is a plan view of the electrical connector shown in FIG. 1, in which, similar to FIG. 1, the half of the ground plate in the longitudinal direction of the connector is omitted.

FIG. 1 is a perspective view showing a whole configuration of the electrical connector according to the embodiment, and FIG. 2 is a plan view thereof. In both figures, a left half of a ground plate attached to the connector is omitted.

A connector 1 is formed to attach to a circuit board (not shown), and extends in left and right directions as shown in the figures. In the connector 1, a ground plate 30 is selectively attached to a connector main body 10.

In the connector main body 10, a plurality of terminals 20 is arranged with a specific interval on a outer side surface 12 among the outer side surfaces 12 and 13 situated in a longitudinal direction of a housing 11 formed of an insulation material and elongated in the left and right directions.

Figure 3:
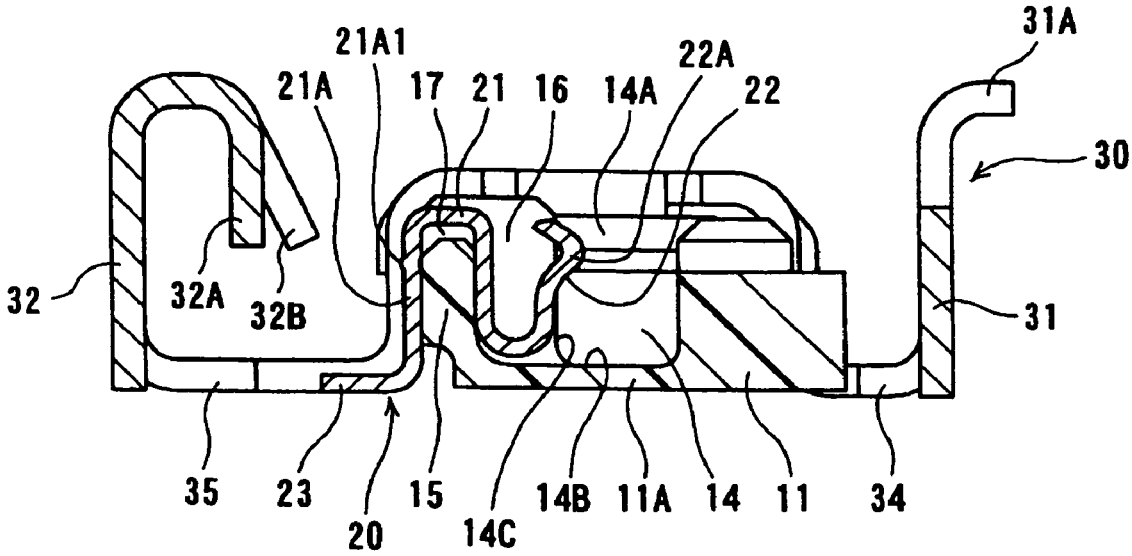
FIG. 3 is a sectional view taken along a line III—III in FIG. 2.

The housing 11 is provided with a fitting protruding portion 14 opening upward and extending up to both ends in the longitudinal direction. Among surrounding walls forming the fitting protruding portion 14, the terminals 20 are arranged on one sidewall portion 15 extending in the longitudinal direction. The fitting protruding portion 14 is situated at a center portion in a width direction, i.e., an direction perpendicular to the longitudinal direction. As shown in FIG. 3, i.e., a sectional view taken along a line III—III in FIG. 2, the fitting protruding portion 14 is formed deep to an extent that a thin bottom wall 11A remains in the housing 11. The fitting protruding portion 14 is provided with receptacle grooves 16 at positions corresponding to the terminals recessing from an inner side surface 14C of the one sidewall portion 15 over a vertical range from a position of an upper opening 14A to a bottom portion 14B or an upper surface of the bottom wall 11A. The receptacle grooves 16 have a depth deep enough for receiving almost whole portion of elastic arms of the terminals (described later). Shallow grooves 17 communicating with the receptacle grooves 16 are formed in an upper end surface and an outer side surface of the sidewall portion 15.

The terminals 20 to be attached to the housing 11 with the receptacle grooves 16 and the grooves 17 are formed of metal thin plates bent relative to a plate surface. As shown in FIG. 3, a sectional shape taken along a plane perpendicular to the plate surface is a substantially S character shape. The terminal has continuously an inverted U character shape portion and a U character shape portion, thereby having a substantially S character shape as a whole. As shown in FIG. 3, the terminal 20 has a fitting portion 21 having an inverted U character shape; an elastic arm portion 22 having a U character shape and connected thereto; and a connecting portion 23 extending from a lower end portion of the fitting portion 21.

The fitting portion 21 is pressed and fitted into the receptacle groove 16 from above, so that the terminal 20 is fixed to the housing 11. The connecting portion 23 bent laterally and extending from the lower end of the fitting portion 21 outside the housing 11 is situated at a level same as that of a bottom surface of the housing 11. When the connector is installed on the circuit board, the connecting portion 23 contacts with the corresponding circuit portion of the circuit board.

The elastic arm portion 22 is bent and extends downward from a lower portion of the fitting portion 21 fitted into the receptacle groove 16, and has elasticity with this flexible portion. The elastic arm portion 22 is provided at an upper end or a free end thereof with a contact portion 22A curved in a state recessed toward outside the receptacle groove 16. The contact portion 22C slightly protrudes from the inner side surface 14C toward inside the receptacle groove 16. When the mating connector is fitted into the fitting protruding portion 14, the contact portion 22C is pushed with the mating connector to elastically deform to a position of the inner side surface 14C toward inside the receptacle groove 16.

The terminal 20 slightly projects from an opening edge of the groove 17 at a portion thereof where the fitting portion is retained in the groove 17 to form a sub-contact portion 21A. In a preferred configuration, a projection 21A1 is formed for securing contact with the mating connector and functioning as lock.

Figure 4:
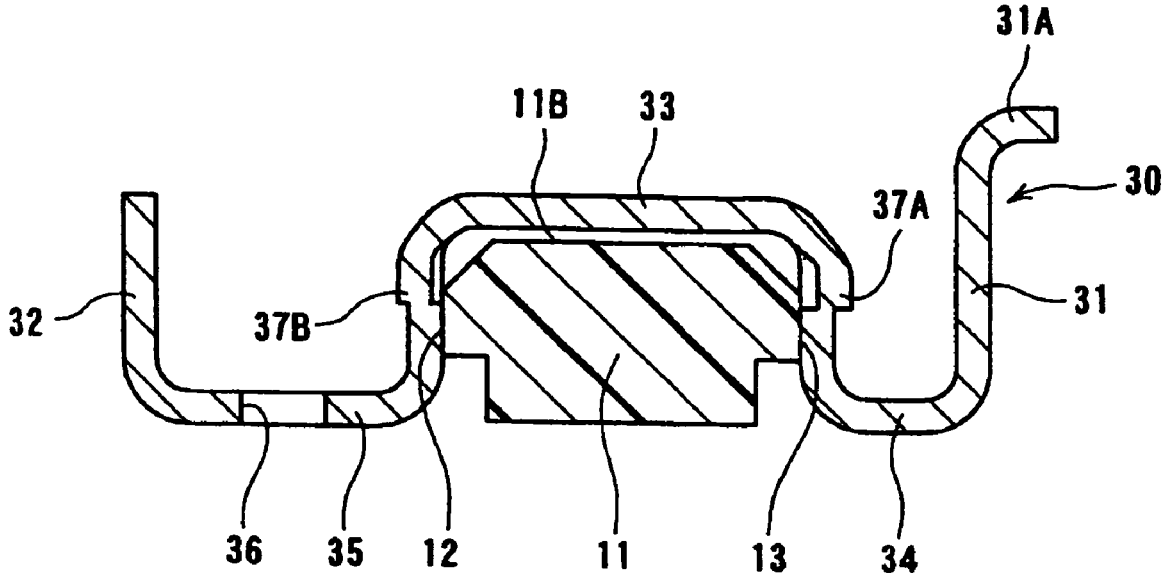
FIG. 4 is a sectional view taken along a line IV—IV in FIG. 2.

As shown in FIG. 4, i.e., the sectional view taken along the line IV—IV in FIG. 2, the housing 11 has ground plate attaching portions 11B at both end portions thereof in the longitudinal direction. The ground plate 30 to be attached to the ground plate attaching portions 11B is formed of one metal plate punched and bent. As shown in FIGS. 1 and 2, the ground plate 30 has ground main portions 31 and 32 situated along the outer side surfaces 12 and 13 of the housing 11, and connecting members 34 and 35 for connecting the ground main portions 31 and 32 to an attaching portions 33. The connecting members 34 and 35 link lower portions of the attaching portions 33 to be attached to the ground plate attaching portions 11B and lower portions of the ground main portions 31 and 32, so that the connecting members 34 and 35 contact with the circuit board at the both end portions of the housing 11 in the longitudinal direction. In the embodiment, the connecting member 35 has an attaching hole 36.

The ground main portion 31 has a surface substantially in parallel to the other outer side surface 13 of the housing 11 with a distance from the outer side surface 13. An upper edge of the ground main portion 31 is situated at a level same as that of an upper surface of the housing 11. The ground main portion 31 has curved projecting portions 31A projecting upward from the upper edge of the ground main portion 31 at only both end portions thereof in the longitudinal direction. Accordingly, when the mating connector is fitted, the upper edge of the ground main portion 31 does not interfere with a cable horizontally extending from the mate connector at a side of the ground main portion 31. That is, since the upper edge is situated at the position of the upper surface of the housing 11, the cable is allowed to extend at the upper position. However, in order to further improve shielding effect of the ground plate, a cut portion may be formed only at a position where the cable extends, and the upper edge may be extend upward, for example, the curved projecting portion may be formed over a whole range in the longitudinal direction except a position of the cut portion.

Similar to the ground main portion 31, the ground main portion 32 has a surface substantially in parallel to the outer side surface 12 of the housing 11 with a distance from the outer side surface 12. It is arranged such that the distance becomes greater than the distance in the case of the ground main portion 13. The connecting portions 23 of the terminals 20 are situated between the ground main portion 32 and the outer side surface 12. The ground main portion 32 and the attaching portions 33 are connected with the connecting members 34 at both end portions in the longitudinal direction where the terminals are not disposed. Accordingly, the ground main portion 32 is apart from the attaching portions 33 to form a space in between, so that the connecting portions 23 are able to contact with the corresponding circuit portion of the circuit board. The ground main portion 32 has two types of curved portions 32A and 32B at an upper edge thereof curved toward inside (the housing side) and arranged alternately in the longitudinal direction. One of the curved portions 32A has a wide width, and the other of the curved portions 32B has a narrow width. The other of the curved portions 32B extends obliquely toward inside further than one of the curved portions 32A to form an elastic tongue piece. The elastic tongue piece forms a contact section for elastically contacting with a mating ground plate when fitted into the mating connector.

As shown in FIG. 4, the attaching portions 33 have an inverted U character shape to be fitted into the ground plate attaching portions 11B provided at the both end portions of the housing 11. Outer surfaces of the attaching portions 33 function as portions where corresponding engaging portions of the mating connector are fitted into from above for engagement. The attaching portion 33 has lock portions on outer surface at both shoulder portions thereof. The lock portions are formed of projections, and include a main lock portion 37A situated at a side where the cable of the mating connector extends and a sub lock portion 37B situated at an opposite side. The main lock portion 37A projects for an amount greater than that of the sub lock portion 37B. That is, the main lock portion 37A engages the corresponding lock portion of the mating connector to a greater extent. A difference in the amount of projection is set in proportion of force received from the mating connector when the mating connector is detached by lifting the cable.

The housing 11 has an absorption portion 40 at a center position in the longitudinal direction of the housing 11 on the side of the other outer side surface 13. The absorption portion 40 forms a portion to be absorbed by an absorption portion of an automated mounting device when the automated mounting device mounts the connector to a specific position on the circuit board. An upper surface 40A is flush with the upper surface of the housing and projects in the width direction of the housing. A side surface of the projecting absorption portion 40 is close to the ground main portion 31. Attaching holes 41 are formed in the upper surface of the absorption portion 40 at both end positions in the longitudinal direction for attaching an auxiliary attaching member. When it is difficult to cope with the automated mounting device only with the upper surface 40A of the absorption portion 40, the auxiliary attaching member is attached to the attaching holes 41 for enlarging an attaching surface. It is preferred that the absorption portion 40 is provided within a width of the mating connector.

The mating connector to be fitted into the connector of the embodiment has a configuration shown in FIGS. 6(A) and 6(B). FIGS. 6(A) and 6(B) are views showing a use state of the connector of the embodiment fitted into the mating connector, wherein FIG. 6(A) shows a state that the connector of the embodiment is used without the ground plate, and FIG. 6(B) shows a state used with the ground plate.

As shown in FIG. 6(A), a mating connector C with a cable indicated by phantom lines has a coaxial cable C2 held between an insulation member and a part of the ground plate C1 and extending laterally in the right direction. A center conductor C3 of the coaxial cable C2 is connected to a terminal C4. The terminal has an inverted U character shape portion and a U character shape to form a substantially S character shape as a whole. The ground plate C1 is attached to an outer side of the connector. The ground plate C1 covers an upper surface of the connector and an outer side surface except a side surface on a side where the cable extends. The mating connector C receives the terminal 20 of the connector of the embodiment inside the inverted U character shape portion of the terminal C4, and the U character shape portion enters the fitting protruding portion 14 of the embodiment.

The connector of the embodiment is used in the following manner.

First, the absorption portion of the automated mounting device absorbs the connector 1 at the absorption portion 40 (absorption surface 40A) of the connector 1, and moves the connector 1 to a specific position on the circuit board. Afterward, the connecting portions 23 of the terminals are connected to the corresponding circuit portions of the circuit board with solder. It is possible to use the connector 1 in the state that the ground plate 30 is attached or in the state that there is no ground plate (only the portion where the ground plate of the mating connector is connected to the board). It is possible to attach the ground plate 30 before or after the connector is arranged on the circuit board. When the ground plate 30 is used, it is preferable to fix with solder at the attaching holes 36 shown in FIG. 4.

Next, as shown in FIGS. 6(A) and 6(B), the mating connector C is fitted into the connector 1. The terminals C4 of the mating connector C contact with the terminals 20 of the connector 1 while surrounding. That is, one of straight portions of the inverted U character shape portion of the terminal C4 contacts with the sub contact portion 21A of the terminal 20 of the connector 1, and an opposite straight portion elastically presses the contact portion 22A. The contact portion 22A is pushed into the receptacle groove 16. The U character shape portion of the terminal C4 of the mating connector enters up to a bottom portion of the fitting protruding portion 14. That is, the U character shape portion of the terminal C4 enters downward up to a position substantially same as the elastic arm portion 22 of the terminal of the connector 1.

As a result, the straight portion contacting with the contact portion 22A has a long contact length during the fitting process, and it is possible to minimize heights of the both connectors upon fitting.

When the connector 1 is provided with the ground plate 30, as shown in FIG. 6(B), the ground main portions 31 and 32 cover the connector 1 sideways over a large range extending in the longitudinal direction of the connector 1. The ground plate C1 of the mating connector C covers the upper portion of the both connectors C and 1. In the ground plate 30 of the connector 1, the contact sections 32B formed as the elastic tongue pieces contact with the ground plate C1 of the mating connector C, thereby mutually conducting at the positions.

The cable C2 extending from the mating connector C is drawn through above the upper edge of the ground main portion 31 without interference with the ground plate.

Figure 5:
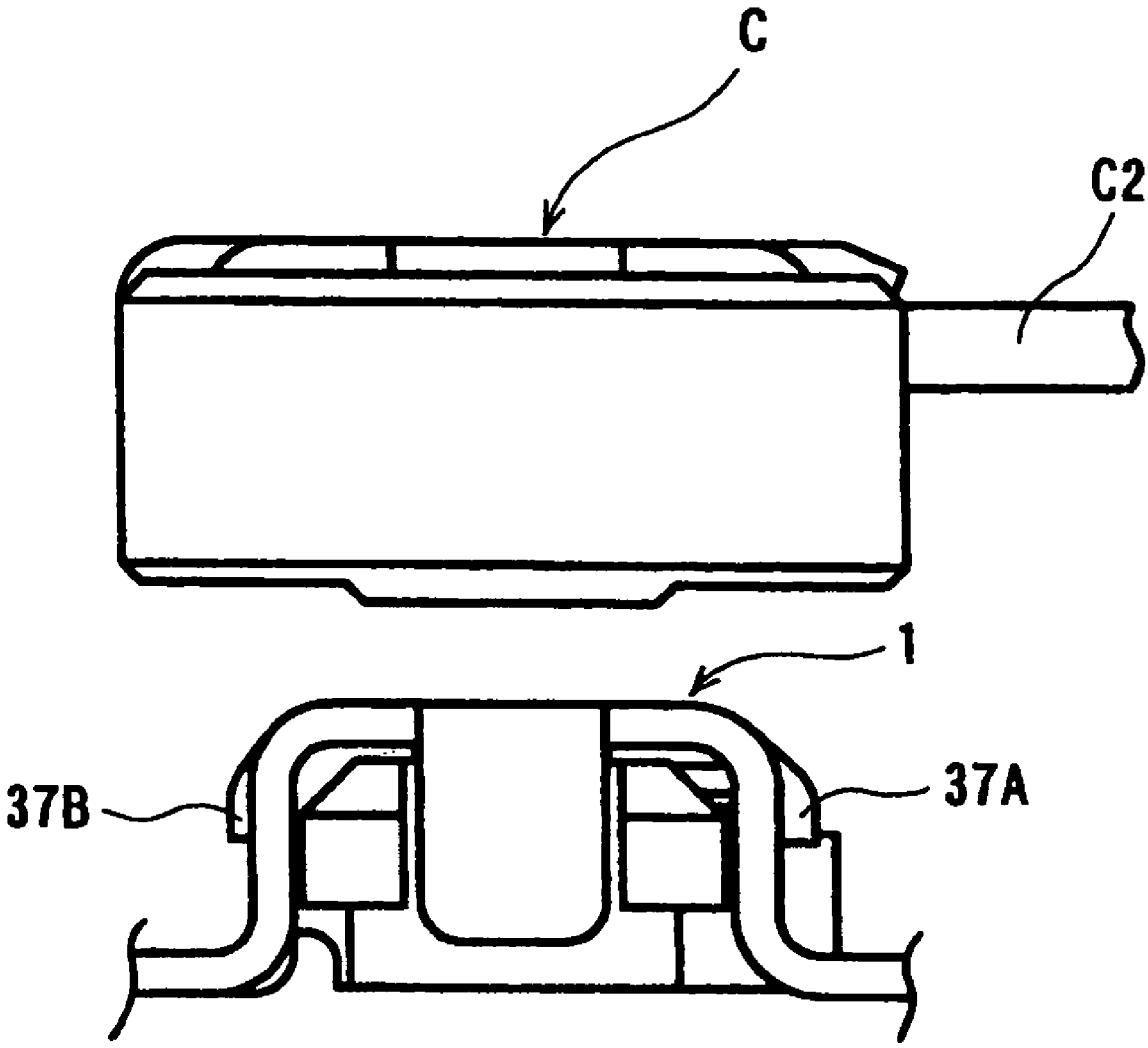
FIG. 5 is a side view of the electrical connector shown in FIG. 1 together with a mating connector.
Figure 6:
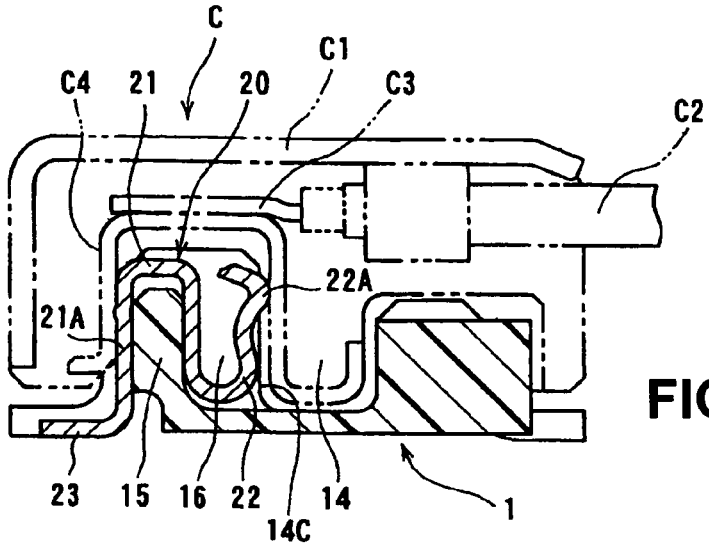
Figure 6:
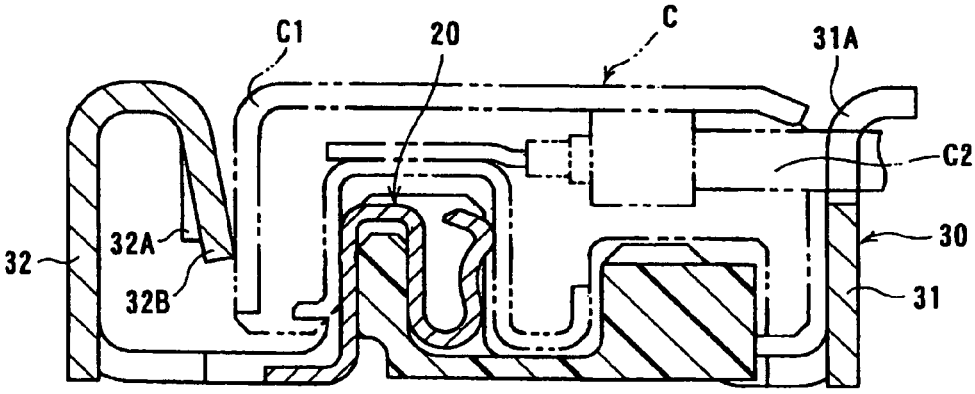
Figure 7:
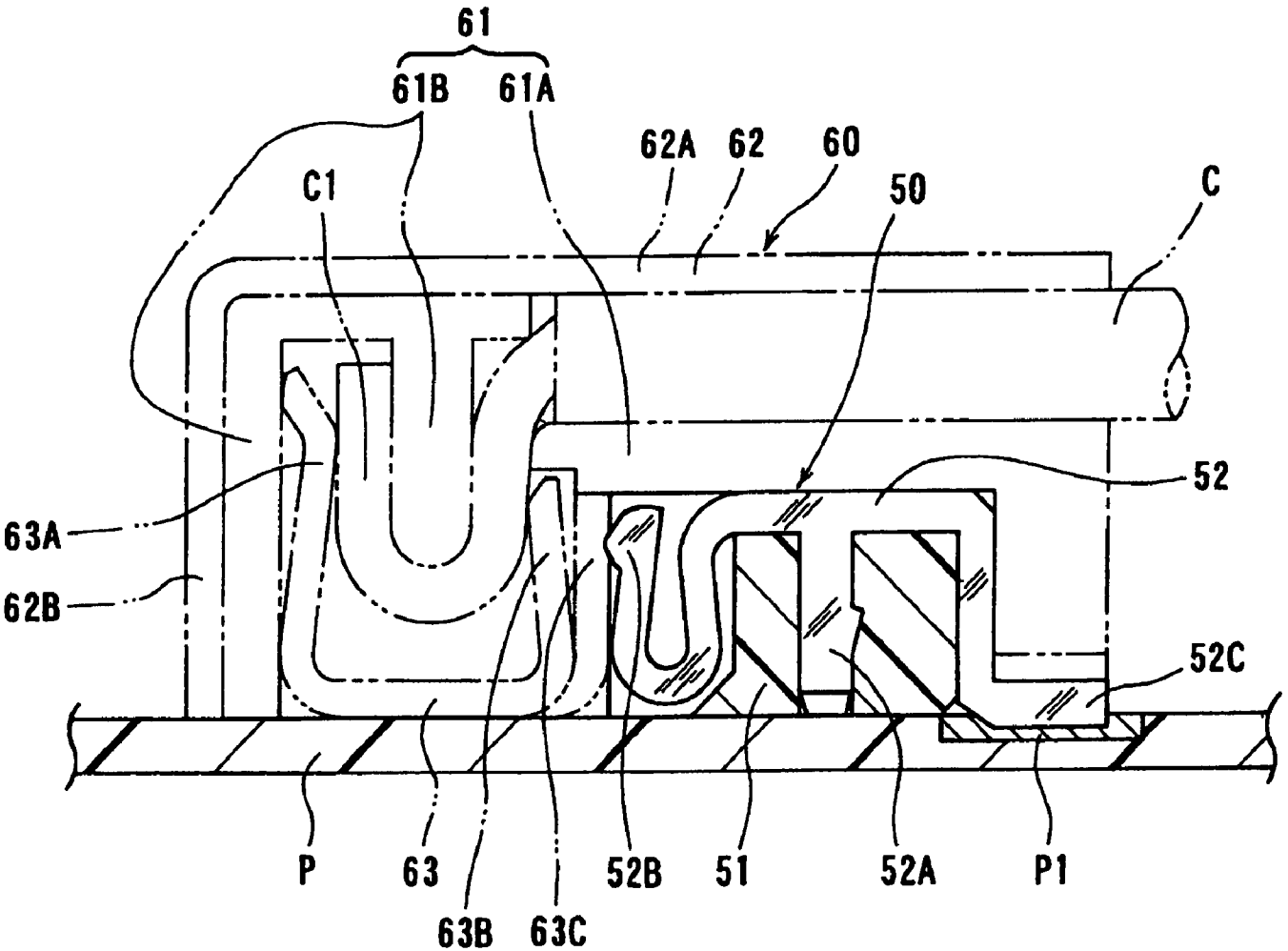
FIG. 7 PRIOR ART
FIG. 7 is a sectional view of a conventional connector.

In the mating connector C, the lock portions (not shown) engage the lock portions 37A and 37B with the projecting shape, so that the connectors are not separated inadvertently. When the cable C2 inadvertently receives upward force, the lock portion 37A close to the cable C2 receives force larger than that of the opposite lock portion 37B as shown in FIG. 5. However, since the lock portion 37A engages to a larger extent than the lock portion 37B, it is possible to properly prevent the connector from coming off according to the balance of force.

When the mating connector C is detached, it is preferred to detach with a tool from the side of the lock portion 37B. In the present invention, the lock portions 37A and 37B are provided at the both end portions of the ground plate 30 in the longitudinal direction, and may be provided on the housing 11. It is preferred that the lock portion of the mating connector is provided on the mating ground plate, so that the lock portion contacts to the lock portions 37A and 37B provided on the ground plate 30.

What is claimed is:

1. An electric connector to be attached to a circuit board, comprising:

a housing having a sidewall portion, a first outer side surface, and a second outer side surface;

a fitting protruding portion formed in the housing for receiving a mating connector, said fitting protruding portion including an opening portion and extending in a longitudinal direction of the housing;

a terminal including a first contact portion for connecting with a mating terminal of the mating connector and a connecting portion arranged on the sidewall portion for connecting to the circuit board; and a ground plate attached to the housing and extending in the longitudinal direction, said ground plate including a first ground main portion facing the first outer side surface and a second ground main portion facing the second outer side surface, said first ground main portion being arranged to form a space between the first ground main portion and the first outer side surface so that the connecting portion can be connected to the circuit board.

2. The electric connector according to claim 1, wherein said ground plate further includes a second contact portion for contacting with a mating ground plate of the mating connector.

3. The electric connector according to claim 1, wherein said ground plate further includes two attaching portions at both end portions thereof in the longitudinal direction for attaching the ground plate to the housing from above; and a connecting member for connecting the first ground main portion and the second ground main portion to the attaching portions at the both end portions, said attaching portions, said first ground main portion, said second ground main portion, and said connecting member being formed of one metal plate.

4. The electric connector according to claim 3, wherein said attaching portions are arranged to fit into the housing, said connecting member being arranged to contact with the circuit board.

5. The electric connector according to claim 1, wherein said ground plate further includes a cut portion for preventing interference with a cable extending from the mating connector in a state fitted to the mating connector.

6. The electric connector according to claim 2, wherein said second contact portion is formed of a tongue piece curved toward at least one of the first outer side surface and the second outer side surface, said tongue piece being arranged to elastically contact with the mating ground plate.

* * * * *